US005294868A

United States Patent [19]

Jones et al.

[11] Patent Number: 5,294,868

[45] Date of Patent: Mar. 15, 1994

[54] DUAL LAMP ELECTRONIC BALLAST WITH INDEPENDENT CONTROL MEANS

[75] Inventors: William H. Jones, Villa Park; John R. Nelson, Franklin Park, both of Ill.

[73] Assignee: Appliance Control Technology, Inc., Addison, Ill.

[21] Appl. No.: 941,704

[22] Filed: Sep. 8, 1992

[51] Int. Cl.[5] ..... H05B 37/00

[52] U.S. Cl. ..... 315/205; 315/219; 315/244; 315/251; 315/312; 315/324; 315/DIG. 7

[58] Field of Search ..... 315/205, 219, 244, 251, 315/324, 312, DIG. 7

[56] References Cited

U.S. PATENT DOCUMENTS 4,415,839 11/1983 Lesea ..... 315/308
4,525,648 6/1985 De Bijl et al. ..... 315/224
5,047,691 9/1991 Lesea et al. ..... 315/244

*Primary Examiner*—Robert J. Pascal
*Assistant Examiner*—Arnold M. Kinkead
*Attorney, Agent, or Firm*—Robert J. Black

[57] ABSTRACT

An electronic ballast circuit for two fluorescent lamps connected in parallel. A single switching inverter connected through a common coupling circuit provides high frequency alternating current for operation of both lamps independently of each other insuring operation of one lamp should the other cease operation. A dual toroidal transformer in the inverter insures both lamps receive current of the same frequency.

8 Claims, 1 Drawing Sheet

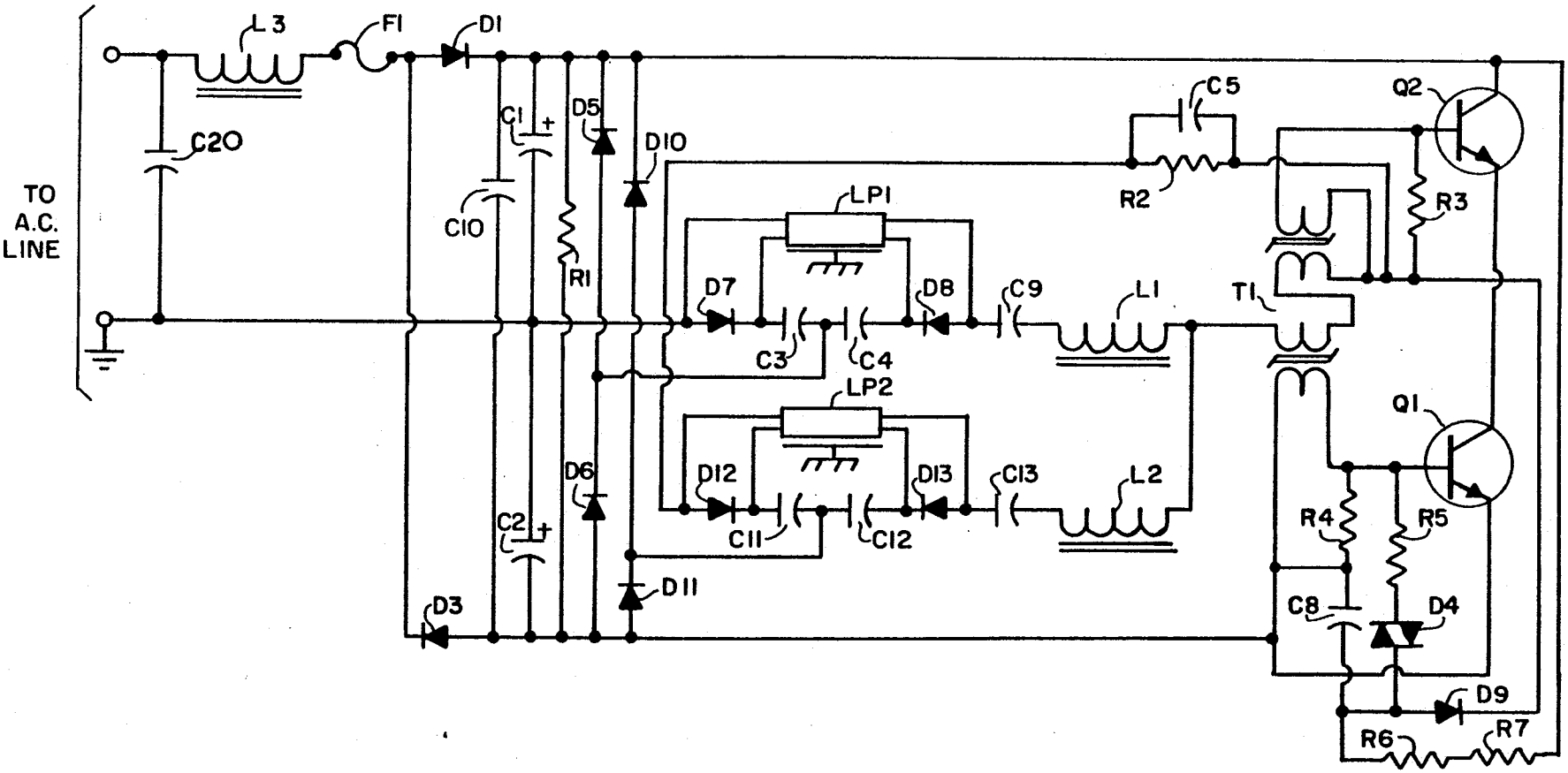
Q2
R3
Q1
R5
D4
D9
R7
R6
R4
C8
T1
C5
R2
L1
L2
C9
C13
D8
D13
LP1
C4
LP2
C12
C3
C11
D7
D12
D10
D11
D5
R1
D6
C1
C2
C10
D1
D3
F1
L3
C20
TO
A.C.
LINE

DUAL LAMP ELECTRONIC BALLAST WITH INDEPENDENT CONTROL MEANS

BACKGROUND OF THE INVENTION

1. Field of the Invention

The present invention relates to fluorescent lighting systems and more particularly to an electronic ballast that operates two fluorescent lamps from the same ballast. Each lamp includes its own series resonant circuit elements while the lamps themselves are connected in parallel. If one lamp burns out, the other continues to operate.

2. Background Art

A search of the background art directed to the subject matter of the present invention conducted in the U.S. Patent and Trademark Office disclosed the following U.S. Pat. Nos.: 4,259,614, 4,375,608, 4,460,849, 4,525,648, 4,641,061, 4,970,438, 5,021,717, 5,032,765, 5,073,745.

A thorough review of the above identified patents indicates that none of the above teach, disclose or claim the novel combination of elements and function found in the improved electronic ballast taught by the present invention.

SUMMARY OF THE INVENTION

It is considered common practice to operate two fluorescent lamps from a single ballast. Most of such arrangements include a basic fault. Should one lamp fail, both lamps then go out. This is usually true because both lamps are operated in a series circuit arrangement. Thus the same current flows through both lamps. The present invention solves the weakness by running the two lamps in a parallel relationship. To accomplish this mode each lamp includes its own series resonant circuit elements which operate completely independent of one another. Thus, if one lamp burns out the other continues to operate.

The present invention employs a common power transistor switching arrangement for both series resonant circuits. A single common toroid assembly is utilized to control the two power transistors included in the switching arrangement. By employing the disclosed concept, the present invention incorporating a single switching regulator means, only a single oscillating frequency is provided for both lamps. By employing a single common frequency, the possibility of noise or harmonic problems that would result with two different frequencies present in the ballast are avoided.

Should a single lamp fail to turn on for any reason, by virtue of the second lamp being in operation the switching means are prevented from remaining in the starting sequence. As a consequence, any possible overload of the transistors is avoided. With a single lamp in operation, the frequency is established at the running value. By employing only one switching means, the cost of the electronic ballast is greatly reduced. Thus it is obvious that only a second inductor and capacitor network is required to operate the second lamp. A capacitor is also employed between the series inductor and the series capacitors in the present invention. This latter capacitor forms an important novel portion of the present invention since its operation aids in starting the second lamp if the other one is turned on first. It is believed that the present invention of a dual lamp electronic ballast meets a greatly felt need in the lighting industry by providing at a cost only slightly higher than that for a single lamp ballast, dual lamp fail safe operation.

BRIEF DESCRIPTION OF THE DRAWINGS

A better understanding of the present invention may be had from a consideration of the following detailed description taken in conjunction with the accompanying drawing in which the drawing is a that of a schematic diagram of an electronic ballast for use with a pair of fluorescent lamps, that includes independent control means in accordance with the teachings of the present invention.

DESCRIPTION OF THE PREFERRED EMBODIMENT

Referring now to the drawing, the means for supplying voltage from a conventional AC line is applied to input circuitry which includes a filter inductor L3 and filter capacitor C20, a fuse F1, diodes D1 and D3, which act as a voltage doubler in a conventional manner providing an output voltage of approximately 300 volts DC appearing across capacitors C1 and C2. This voltage is then applied to the switching regulator circuitry which includes transistors Q1 and Q2 and the associated components. On initial startup, the switching regulator oscillator is not running. It needs a "kick" to get started. This is provided by charging capacitor C8 through resistors R6 and R7 until the breakdown voltage of diac D4 is exceeded. This breakdown voltage is typically 32 volts. Diac D4 then conducts voltage stored in capacitor C8 to the base of power transistor Q1. It should be noted that once the oscillator circuitry is running, diode D9 then prevents capacitor C8 from charging up enough to retrigger the diac.

When transistor Q1 is turned on, current will flow out of capacitor C2 through one or both lamp LC control circuits, and thence through the dual toroid transformer T1 to the collector of transistor Q1 and back to the negative end of capacitor C2. With current flowing through the toroid T1 base drive current for transistor Q1 is supplied. At this time, the ferrite ring becomes quickly saturated and further base current is prevented. Transistor Q1 will now turn off resulting in a reverse voltage spike from the stored energy causing transistor Q2 to become conductive. Current now flows out of capacitor C1 through transistor Q2 through the toroid T1 and back through the LC lamp control circuits to the negative end of capacitor C1. Thus an alternating high frequency current is created by the switching action of the dual toroid T1 and the associated transistors Q1 and Q2. Each power transistor (Q1 and Q2) has a base resistor (R3 and R4, respectively) to limit possible voltage appearing at the base to prevent malfunction due to excessive voltage from the toroid winding.

As may be seen from the drawing, current for both lamps flows through a common toroid T1, thus, the operating frequency for both lamps will be identical.

Each LC circuit operates in the same manner. The inductor L1 and capacitors C3 and C4, or in the alternative inductor L2 and capacitors C11 and C12, form an LC series tank circuit. Values of inductance and capacitance are selected so as to have a resonant frequency of about 30 kilohertz. The "Q" of the circuitry is sufficient to generate a voltage of at least 300 volts across the ends of the fluorescent lamps. The series current flows through the filaments at each end of the fluorescent lamp to preheat the lamps function to produce electrons. These electrons are boiled off by the time the "Q"

of the circuit is built up to the high breakover voltage. Initially, Each lamp has a high impedance, which drops to less than 200 ohms once its becomes ignited. Most of the current then flows through the lamp instead of through the parallel capacitors. Diodes D7 and D8, associated with lamp LP1 and diodes D12 and D13 associated with lamp LP2 are used to reduce the voltage drop across the filaments. In some lamps with typical differing filament impedances the diodes are not required to protect against any over voltage that might cause early burnout or future failure of the elements. The capacitors C3 and C4 have a midpoint connection between them, tied through diodes D5 and D6 to the positive and negative rails of the DC power supply portion. Similarly, capacitors C11 and C12 have their midpoint connected to a point between diodes D11 and D10 which also provide connection to the DC rails. This arrangement serves as a clamp to prevent excessive voltages on initial startup. If the "Q" of the circuit creates a voltage higher than the DC bus voltage, the steering diodes D5 and D6 or D10 and D11 become conductive and limit any possible excessive voltages. Capacitors C9 and C13 assist in the starting of associated lamps LP1 and LP2, respectively.

In the construction of a practical embodiment of the present invention, two type F17T8/SB30/RS fluorescent Octron lamps were employed. Ballast circuitry of the present invention successfully operated the two fluorescent lamps independently from another. The efficiency measure was 90 percent with a crest factor for current through the lamps at 1.5. The electronic ballast was able to start both lamps with line voltage reduced to as low as 100 volts. During testing, the input and output electrical characteristics of the ballast were measured with 120 volts 60 hertz line. Input power was measured with a Model 2101 Valhalla True RMS instrument. Output on the other hand was measured using a Fluke Model 8020A instrument with a suitable current probe. The test results determined were as follows:

| | Output: | |
|---|---|---|
| Input: | Lamp 1 | Lamp 2 |
| 120 V., 60 Hz | 63.0 V | 65 V. |
| .704 Amps | .288 Amps | .304 Amps |
| 42.0 Watts | 18.7 Watts | 19.1 Watts |
| 49.7 P.F. | 1.5 C.F. | 1.5 C.F. |
| 90.0% Eff. | 28.1 KHz | 28.1 KHz |

It was found that the lamps came on after a short preheat of the filaments as is intended for Octron type lamps. The electronic ballast, after being operated for a long period of time, was determined to have no temperature problems.

While but a single embodiment of the present invention has been shown, it will be obvious to those skilled in the art that numerous modifications may be made without departing from the spirit of the present invention which should be limited only by the scope of the claims appended hereto.

What is claimed is:

1. An electronic ballast for first and second fluorescent lamps, said ballast comprising:
   a rectifier circuit connected to a source of alternating current, operated to produce direct current;
   a switching type inverter circuit connected to said rectifier circuit, operated to generate a high frequency alternating current;
   first and second parallel connected resonant circuits each connected to said inverter circuit by means of a common coupling means;
   said first resonant circuit operated to conduct said high frequency alternating current to said first fluorescent lamp whereby said lamp is operated;
   said second resonant circuit operated to conduct said high frequency alternating current to said second fluorescent lamp whereby said lamp is operated;
   said first and second resonant circuits each including an LC circuit comprising an inductor in series with a capacitance, said capacitance connected in parallel with an associated one of said fluorescent lamps; and
   said capacitance comprising first and second capacitors in series including a center tap between said capacitors connected to said rectifier circuit by means of first and second diodes.
2. An electronic ballast as claimed in claim 1 wherein: said rectifier circuit is a voltage doubler circuit.
3. An electronic ballast as claimed in claim 2 wherein: said rectifier circuit further includes filter means.
4. An electronic ballast as claimed in claim 2 wherein: said rectifier circuit further includes fusing means.
5. An electronic ballast as claimed in claim 1 wherein: said switching type inverter circuit includes first and second transistors each including circuit connections to said common coupling means.
6. An electronic ballast as claimed in claim 5 wherein: said switching type inverter circuit in combination with said common coupling means operates as an oscillator to generate a high frequency alternating current providing operating current of said high frequency to both said first and second lamps, through said first and second resonant circuits, respectively.
7. An electronic ballast as claimed in claim 1 wherein: there is further included a third capacitor connected in series between said inductor and said first and second capacitors in said first and second resonant circuits;
   said third capacitor assisting in the starting of said associated lamp.
8. An electronic ballast as claimed in claim 1 wherein: said common coupling means comprise a dual toroidal transformer including circuit connections to said first and second transistors to said first resonant circuit and to said second resonant circuit.

* * * * *